United States Patent [19]

Epstein et al.

[11] 4,015,374

[45] Apr. 5, 1977

[54] ANGLED CAP MEMBER FOR SIMULATED CEDAR SHAKE CONSTRUCTION

[75] Inventors: George Epstein, Akron; Robert E. Mollman, Chagrin Falls, both of Ohio

[73] Assignee: Alside, Inc., Akron, Ohio

[22] Filed: Mar. 6, 1974

[21] Appl. No.: 448,623

Related U.S. Application Data

[62] Division of Ser. No. 332,163, filed Feb. 13, 1973.

[52] U.S. Cl. ..... 52/57; 52/278; 52/314; 52/551; 52/555

[51] Int. Cl.[2] ..... E04D 1/30

[58] Field of Search ..... 52/459, 461, 465, 466, 52/467, 462, 726, 277, 547, 549, 57, 60, 43, 554, 555, 551, 278, 314

[56] References Cited

UNITED STATES PATENTS

| | | | |
|---|---|---|---|
| 397,535 | 2/1889 | Carroll | 52/276 |
| 2,188,090 | 1/1940 | Young | 52/459 |
| 2,255,247 | 9/1941 | Gabriel | 52/278 |
| 2,725,832 | 12/1955 | Huntington | 52/278 X |
| 3,173,229 | 3/1965 | Weber | 52/549 X |
| 3,217,453 | 11/1965 | Medow | 52/314 |
| 3,232,020 | 2/1966 | Gillis | 52/547 X |
| 3,411,259 | 11/1968 | Anderson et al. | 52/555 X |
| 3,651,610 | 3/1972 | Donahue | 52/278 |
| 3,757,483 | 9/1973 | Torbett | 52/547 |
| R27,502 | 10/1972 | Martin | 52/551 X |

FOREIGN PATENTS OR APPLICATIONS

| | | | |
|---|---|---|---|
| 32,799 | 2/1928 | France | 52/547 |
| 433,217 | 8/1935 | United Kingdom | 52/555 |

*Primary Examiner*—Leslie Braun
*Attorney, Agent, or Firm*—Fidelman, Wolffe & Waldron

[57] ABSTRACT

An angled cap member is provided to finish off hips and ridges for use with a simulated cedar shake panel for walls or roofs having at least two courses of simulated shakes in relief therein, the shakes being in overlapped and underlapped relation with a varied butt line, and recessed underlaps between side-by-side shakes.

5 Claims, 7 Drawing Figures

40
41
42
43
44
45
46
48
50
2
3
4
5

ANGLED CAP MEMBER FOR SIMULATED CEDAR SHAKE CONSTRUCTION

The present invention is a division of Ser. No. 332,163, filed Feb. 13, 1973 and relates to an angled cap member used in construction involving a simulated wood shake roof and siding and in particular simulated cedar shakes.

Wooden shakes are a well known and attractive material of construction. Cedar shakes in particular provide desirable material for siding and roofing, having been widely and extensively employed for many years, Unfortunately, although numerous householders would be delighted to side and/or roof their homes and businesses with cedar shakes, the truth of the matter is that the shakes are quite expensive and moreover require a great amount of expensive hand labor to install. This situation has given rise to a considerable body of art on simulated shakes made from metals (such as aluminum and galvanized steel), minerals (such as cement and asbestos compositions), even fiberglass laminates.

Unfortunately, the simulated shakes suggested heretofore to the art seem all to suffer from one or more undesirable attributes. Thus, for example, a simulated shake replicates the molding surface on which it is formed. No matter how closely the shake may resemble its natural counterpart, any roof or siding to which a multiplicity of individual simulated shakes are applied, evidences the repetitive identity of form and shape inherent in the replicated sameness of each simulated shake. The visual effect is quite different from the no-two-alike look of a natural shake roof or siding. A separate disadvantage inherent in individual simulated shakes is that the high labor costs involved in the shake-by-shake installation of a shake siding or roof has not been particularly avoided.

Installation labor costs can be substantially decreased by adoption of a panel expedient, namely a panel whose face has thereon a multiplicity of simulated shakes in a suitable assembled together configuration. The configuration in the panel face can be varied, shake-to-shake, and to that extent at least, the visual effect of shake-to-shake identity is avoided. However, a panel-to-panel identity exists and the need to conceal joints between adjacent panels becomes important. Indeed, some panel modes suggested to the art contemplate panel-to-panel joint configurations inconsistent with the highly individualized random appearance of true shake construction.

Briefly stated, the present invention involves a simulated shake ridge cap which together with a simulated shake panel can be employed to roof and face a building structure in simulated cedar shakes in an attractive non-repetitive simulated shake configuration. Reference is made to the aforementioned Ser. No. 332,163, filed Feb. 13, 1973, for detailed description of a preferred panel.

The present simulated shake ridge cap is well adapted for use with simulated shake panels that constitute good simulations of natural shakes. The panel of the aforementioned Ser. No. 332,163 is considered to be a good simulation, and the structure thereof is exemplary of the relationship between ridge cap and panel. That simulated shake panel is a relatively elongated board long enough (e.g. 5 feet) and high enough (e.g. 18 inches) to have what appears to be at least two courses of shakes on the face of the panel, with each course having therein a multiplicity of shakes (preferably more than five shakes). Thus the face of an exemplary panel appears to be an assembly of twenty highly individualized shakes disposed in two courses of ten shakes each. The simulated shakes, no two exactly alike, appear as they would be in true shake construction, some shakes overlapped and some shakes underlapped.

A common feature of true shake construction is that the ridges on roof peaks and hips are covered by individual shakes. Simulated shake panels can be employed with a ridge or hip cap simulative of true shake construction and preferred simulated shake cap members are contemplated by the present invention.

Also forming part of the present invention is a gable strip or trim member particularly adapted for use at the juncture of the simulated shake ridge cap and the simulated shake panels and at the exposed edges of the structure. The gabel strip constitutes a rain trap for any rain wind-driven between the ridge cap and the simulated shake panel. The rain trap will help to effectively drain such water off the roof. The preferred gable strip member is of particular value for hip roof construction where considerable wind-driven rain might be forced into the juncture area between cap and the simulated shake panel.

For further understanding of the present invention, reference is now made to the attached drawings wherein.

A structure sheathed and roofed with shakes, simulated or natural, will frequently be finished off with shake ridge caps, and use of simulated equivalents thereof as required is contemplated with simulated shake panels 12. The drawings illustrate preferred modes of ridge cap 40, these modes being particularly adapted for installation along with the simulated shake panels of the aforementioned Ser. No. 332,163.

Figures 1, 2, 3, 4:
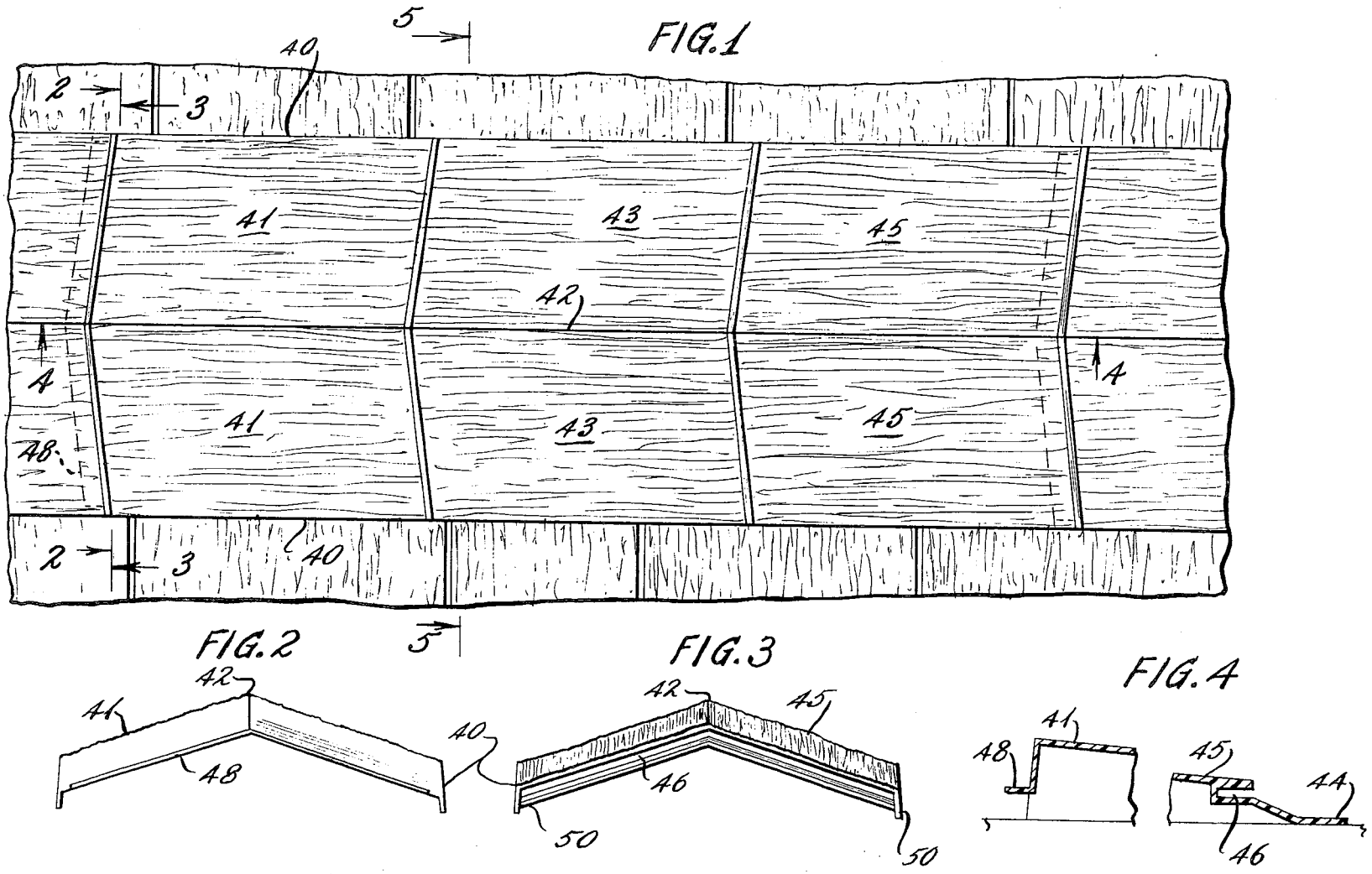
FIG. 1 is a plan view of a ridge cap.
FIG. 2 is a transverse section on the line 2—2 of FIG. 1, illustrating one end of the ridge cap in elevation.
FIG. 3 is a transverse section on the line 3—3 of FIG. 1, illustrating the opposite end of the ridge cap in elevation.
FIG. 4 is a longitudinal section on the line 4—4 of FIG. 1, broken away.

The cap 40 is an angled member having a central ridge 42 thereon. A multiplicity of simulated, apparently overlapped shakes (as for example, shakes 41, 43, 45) extend in a row on each side of the ridge line. A roof ridge or hip is topped by as many ridge caps 40 abutted, angled end to angled end as is needed, as is shown in FIG. 1. At one angled end, each ridge cap 40 is provided with a nailing strip 44 which forms the base leg of a U-shaped channel 46. The other (upper) leg of channel 46 forms the terminal edge of a simulated shake, e.g. shake 45. Correspondingly, the opposing angled edge of ridge cap 40 is provided with a flange 48 sized and positioned to interfit the channel 46 of an abutting ridge cap. Except to close examination, the joint between adjacent ridge caps, namely the juncture of shakes 41, 45 is indistinguishable from the shake-to-shake junctures built into cap member 42.

Each of the longitudinal side edges of cap member 40 terminates in a downwardly extending tongue 50. As may be seen in FIG. 1, ridge cap 40 overlaps panels 12 and tongue 50 rests on the overlapped panel, the overlap and presence of tongue 50 serving to seal off underside of ridge cap member 40 from wind and rain.

Figure 5:
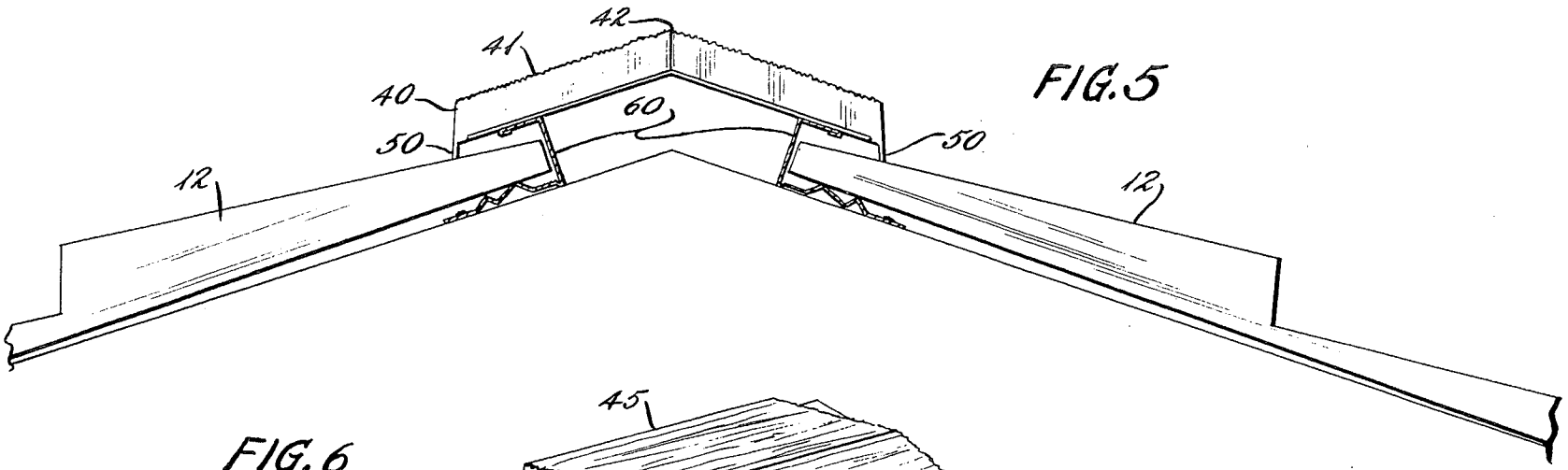
FIG. 5 is a section on the line 5—5 of FIG. 1.
Figure 6:
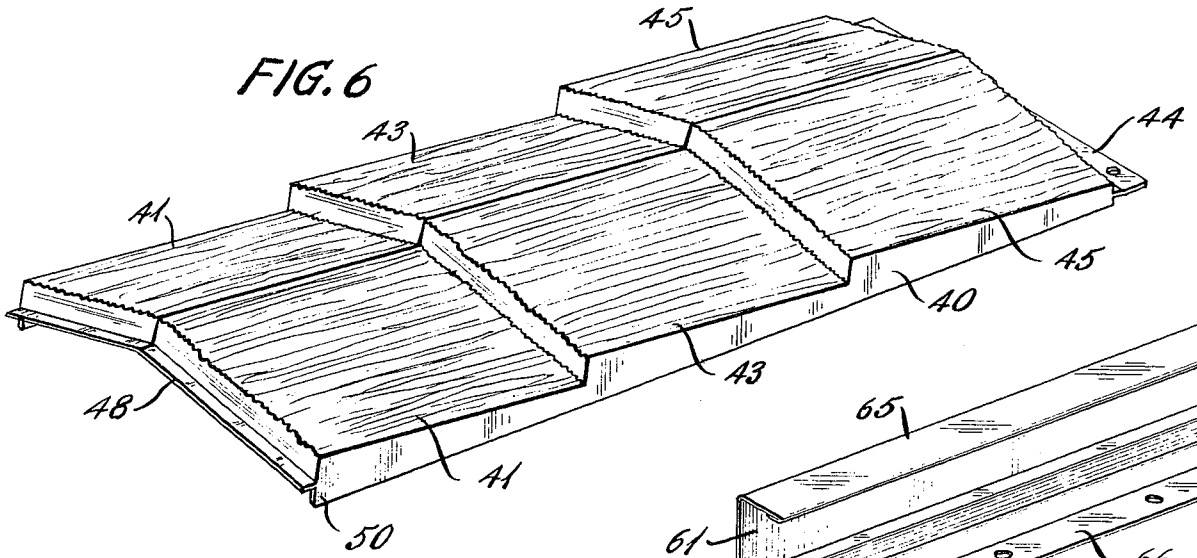
FIG. 6 is a perspective view of the ridge cap member of the present invention.
Figure 7:
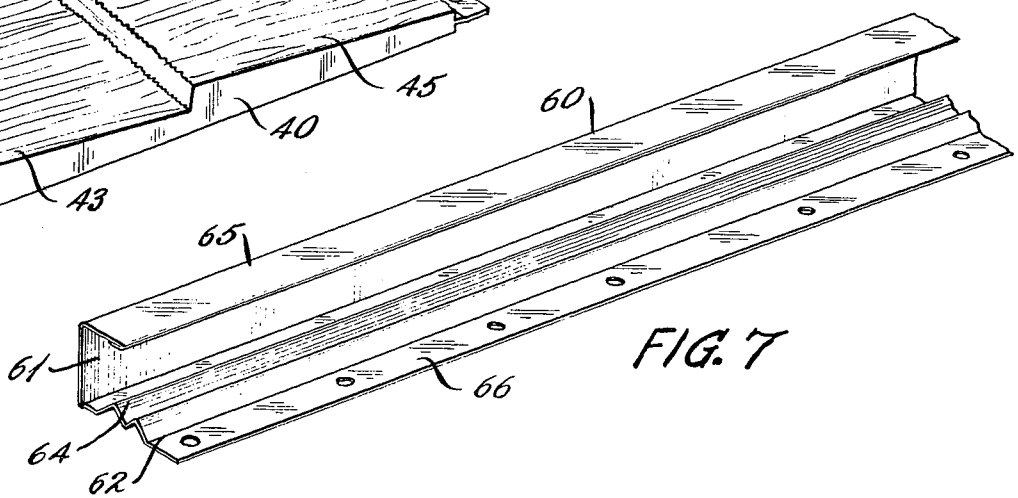
FIG. 7 is a perspective view of the gable strip member.

However, where wind-driven rain may easily be forced under tongue 50, in hip roofs for example, a gable strip (preferably metallic) may be interposed between ridge cap 40 and the topmost edge of panels 1. A preferred mode of gable strip 60 is illustrated in FIG. 7. The gable strip 60 comprises an elongated deformed U-shaped channel 61 wherein one leg 62 of the channel has an inward bend 64 directed toward the other leg 65. A nailing tab 66 extends from the deformed or bent leg. This gable strip is nailed to the roof parallel to the hip or ridge, with its opening away from the ridge or hip as shown in FIG. 5. After the gable strip 60 is installed, the cut-off edge of a panel 12 enters channel 61 to seat on bend 64 while the underside of ridge cap 40 rests on the channel leg 65 of gable strip 60.

Any water driven under tongue 50 on cap member 40 will pass beneath channel leg 65, then around the edge of panel 12, thereafter be caught in the rain trap formed inside gable strip 60 by bend 64 and flow off the roof.

FIG. 5 illustrates the expectation that the topmost simulated shake panel will have been trimmed to fit the actual space left for the top course of panels (also, the ridge cap nailing tab 44 will be trimmed to allow for the gable strip). FIG. 5 illustrates how the space directly beneath cap 42 is open, ventilating the roof. FIG. 5 also illustrates a 150° cap member and the roof ridge to which such a cap member is adapted. For hip roofs in particular, cap members with other angles, e.g. 120°, may be provided.

What is claimed:

1. A cap suitable for ridges and hips on a simulated shake roofing, said cap being characterized by the appearance of individual shakes and comprising:

an angled cap member having a central ridge extending longitudinally lengthwise thereof and angled side edges;

a plurality of simulated apparently overlapped shakes extending along the length of said cap member, on each side of the central ridge thereof;

a downwardly extending tongue forming each longitudinal edge of said cap member adapted to rest on a first course of simulated roof shakes;

means at the angled side edges of said cap member for interfitting successive like cap members angled side to angled side; and nailing means at one of said angled side edges for securing said cap member to a roof.

2. A ridge cap for a simulated shake roofing characterized by the appearance of individual shakes comprising an angled cap member having a central ridge extending longitudinally lengthwise thereof;

a plurality of simulated apparently overlapped shakes extending along the length of said cap member, on each side of the central ridge thereof;

a downwardly extending tongue forming each longitudinal edge of said cap member, and adapted to rest on a first course of simulated roof shakes;

an outwardly extending nailing tab forming one lateral side marginal edge of said cap member, said tab being the base leg of an outwardly open U-shaped channel formed at the top of said cap member;

an outwardly extending flange forming the other lateral side marginal edge of said cap member, said flange being sized and offset to interfit the U-shaped channel whereby successive cap members can interfit.

3. The ridge cap of claim 2 wherein each terminus of said channel and of said flange is spaced inward of the nearest longitudinal edge of said cap member.

4. A simulated shake hip or peaked roofing comprising:

a plurality of simulated shake panels assembled and joined end to end and top to bottom with each panel individually nailed down through the nailing means hereinafter described, said panels terminating at each side of a roof ridge;

and a plurality of simulated shake ridge caps disposed on a roof ridge, individually nailed thereto, each said ridge cap characterized by the appearance of individual shakes comprising an angled cap member with angled side edges thereon overlapping the closest panel edge on each side of the roof ridge, said plurality of ridge caps being joined angled edge to angled edge;

said cap member further comprising:

a plurality of simulated apparently overlapped shakes extending along the length of said cap member, on each side of the central ridge thereon;

a downwardly extending tongue forming each longitudinal edge of said cap member, and adapted to rest on a first course of simulated roof shakes;

means at the angled side edges of said cap member for interfitting successive like cap members angled side to angled side, and nailing means at one of the angled side edges for securing said cap member to a roof.

5. The roofing of claim 4 wherein a gable strip is interposed between the ridge caps and panels, said gable strip comprising a deformed U-shaped channel wherein one leg of said channel has a bend therein directed toward the other leg of said channel;

a nailing tab extending from said bend containing leg, said U-shaped channel being sized to straddle the edge of a simulated shake panel overlapped by said ridge caps whereby, when said gable strip is nailed to said roof with the channel parallel to a ridge thereon open away therefrom and the nailing strip in contact with the roof, the edge portion of a simulated shake panel is straddled by the channel legs to seat on the bend in said one leg and a ridge cap is seated on the other channel leg, overlapping thereby ridge cap and panel with the gable strip therebetween to provide a rain trap in the gable strip portion between the base of the U-shaped channel and the bend in the channel leg.

* * * * *